US005799368A

United States Patent [19]

Young

[11] Patent Number: 5,799,368

[45] Date of Patent: Sep. 1, 1998

[54] ROLLER BRACKET APPARATUS FOR AN OVERHEAD DOOR

[76] Inventor: James Richard Young, 3881 Amador Way, Reno, Nev. 89502

[21] Appl. No.: 656,926

[22] Filed: Jun. 3, 1996

[51] Int. Cl.[6] ..... E05D 15/38

[52] U.S. Cl. ..... 16/92; 160/209; 160/201; 16/87 R

[58] Field of Search ..... 16/90, 91, 92, 16/87 R; 160/201, 209

[56] References Cited

U.S. PATENT DOCUMENTS

| | | | |
|---|---|---|---|
| D. 337,042 | 7/1993 | Lin et al. | D8/349 |
| 2,008,959 | 7/1935 | Johnson | 160/209 |
| 2,045,101 | 6/1936 | Robinson | 160/209 |
| 2,099,191 | 11/1937 | Blodgett | 160/209 |
| 2,294,361 | 9/1942 | Blodgett | 160/209 |
| 2,401,857 | 6/1946 | Buehner | 160/209 |
| 4,095,641 | 6/1978 | Olson | 160/209 |
| 4,878,529 | 11/1989 | Hormann | 160/201 |
| 5,042,556 | 8/1991 | Ruiter | 160/201 |
| 5,135,040 | 8/1992 | Ruiter | 160/201 |
| 5,235,724 | 8/1993 | Perrin et al. | 16/97 |

FOREIGN PATENT DOCUMENTS

| | | | |
|---|---|---|---|
| 1101086 | 1/1968 | United Kingdom | 160/209 |

*Primary Examiner*—Chuck Mah
*Assistant Examiner*—Donald M. Gurley

[57] ABSTRACT

A roller bracket apparatus includes a roller assembly which includes a carriage portion and a link portion projecting from the carriage portion. A push/pull assembly is provided, and a pivot assembly is connected between the link portion of the roller assembly and the push/pull assembly. The carriage portion includes a wheel-support portion and a plurality of axle/wheel assemblies supported by the wheel-support portion. Each of the axle/wheel assemblies includes an axle and a roller wheel connected to the axle. The link portion extends from the carriage portion at an oblique extension angle. The push/pull assembly includes a first member connected to the pivot assembly, and a second member is connected to the first member. The push/pull assembly also includes a third member connected between the first member and the second member. The second member of the push/pull assembly is oriented with respect to the link portion of the roller assembly substantially in a straight line when the second member of the push/pull assembly is oriented with respect to the wheel-support portion of the roller assembly at a right angle. On the other hand, the second member of the push/pull assembly is oriented with respect to the link portion in an oblique link-to-second-side orientation angle when the second member is oriented with respect to the wheel-support portion in a straight line. The link-to-second-member orientation angle is less than the extension angle.

3 Claims, 2 Drawing Sheets

FIG 2
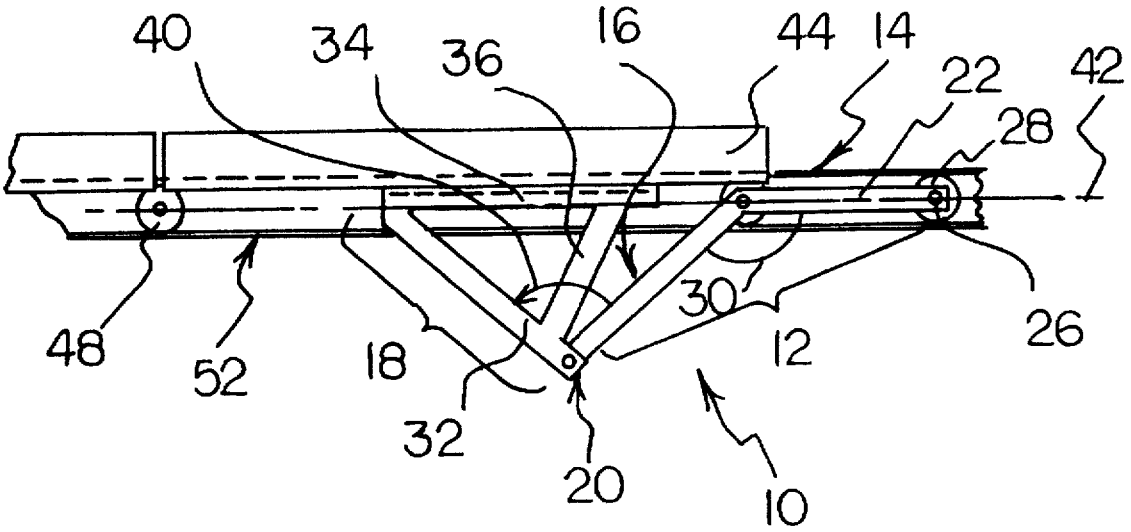
FIG 3
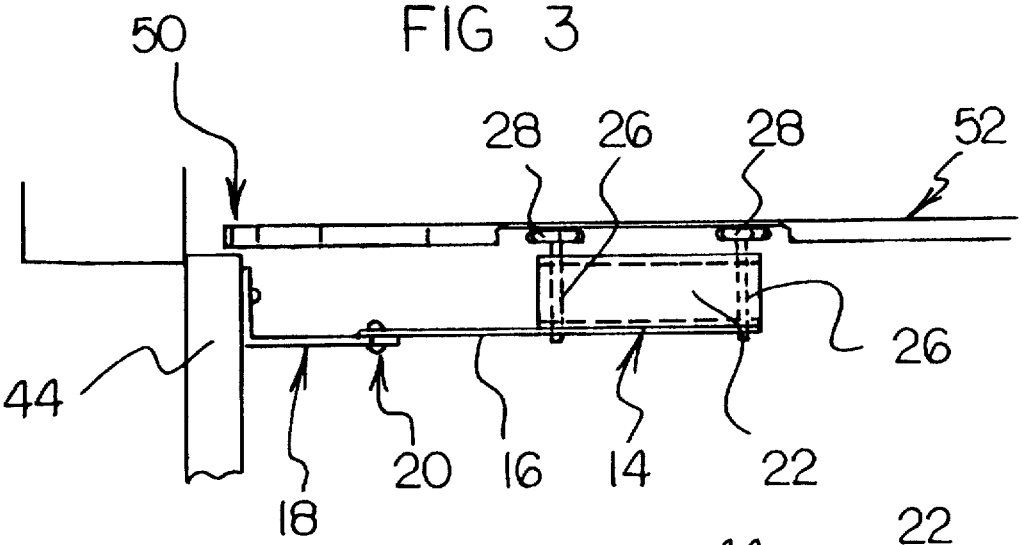
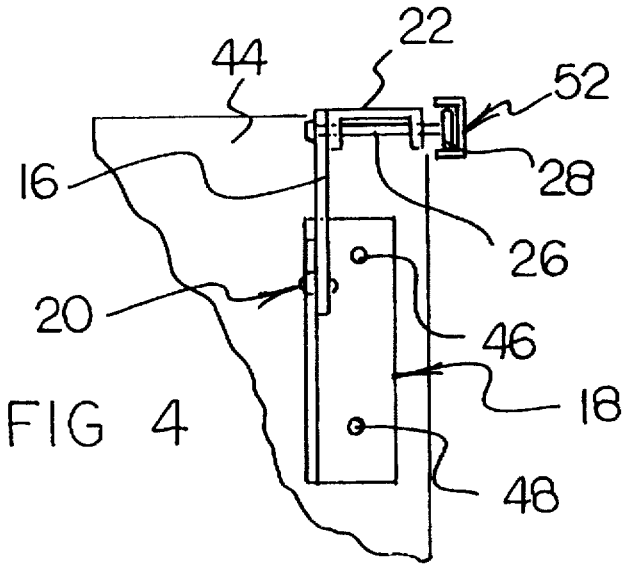
FIG 4

ROLLER BRACKET APPARATUS FOR AN OVERHEAD DOOR

BACKGROUND OF THE INVENTION

1. Field of the Invention

The present invention relates generally to overhead doors and, more particularly, to brackets for retaining rollers for a top panel in an overhead door.

2. Description of the Prior Art

Overhead doors are well known. Especially common are sectional, roll up doors that employ a pair of tracks for rollers. Each track has a vertical portion for retaining door panels in a vertical or closed orientation, and each track has a horizontal portion for retaining door panels in a horizontal or open orientation. In the area of overhead doors, the concept of headroom relates to the space above a closed door that is required for retaining the horizontal portions of the tracks. Moreover, the headroom space retains the overhead door when the overhead door is in an open or horizontal orientation. For optimum action, many conventional overhead doors require a headroom space that has a height of twelve inches. However, due to construction of a structure, such as a garage, often less than a standard height of twelve inches is allowed for the headroom space.

When less than twelve inches of headroom space are provided, several alternatives are known. One such alternative is the provision of what are known as low headroom tracks which require only six inches height for headroom space. However, such low headroom tracks are expensive and excessively time consuming to install. In this respect, it would be desirable if a device were provided for an overhead door that does not use low headroom tracks.

Another alternative to having a twelve inch height for a headroom space is to cut several inches from the bottom of the vertical portions of the roller tracks. In this way, the horizontal portions of the tracks would be lowered. When this is done, known substitute top brackets need to be installed at the two top corners of the door. Such known substitute top brackets are disclosed in U.S. Pat. No. 4,095,641 and may not perform as well as intended. In this respect, it would be desirable if a device were provided for an overhead door that does not employ known top brackets that are employed with overhead doors for which several inches have been cut from the bottoms of vertical portions of the roller tracks.

As discussed above, provisions are made in the prior art for a vertical height of headroom space to be in a range of six to twelve inches. However, there are applications that may call for a vertical height of headroom space to be less than six inches. In this respect, it would be desirable if a device were provided for an overhead door that permits a vertical height for headroom space to be less than six inches. Moreover, there may also be applications in which it would be desirable for the vertical height of headroom space to be no higher than the vertical distance required by the horizontal portions of roller tracks.

Aside from U.S. Pat. No. 4,095,641 mentioned above, throughout the years, a number of innovations have been developed relating to overhead doors, and the following U.S. patents are representative of some of those innovations: U.S. Pat. Nos. 4,878,529, 5,042,556, 5,135,040, 5,235,724, and U.S. Pat. No. Des. 337,042. More specifically, U.S. Pat. No. 4,878,529 discloses an overhead door that has door-pulling gear located above the horizontal portions of roller tracks. Consequently, a relatively large vertical height is needed for the headroom space. In this respect, it would be desirable if a device were provided for an overhead door that does not include door-pulling gear located above the horizontal portions of roller tracks.

Each of U.S. Pat. Nos. 5,042,556 and 5,135,040 discloses an overhead door that includes a pair of stationary corner wheels that change vertical to horizontal motion for the door panels. It would be desirable to avoid the installation and the expense of such direction-changing stationary corner wheels. In this respect, it would be desirable if a device were provided for an overhead door that avoids the use of stationary, direction-changing corner wheels.

U.S. Pat. No. 5,235,724 may be of interest for its disclosure of a roller-hinge assembly for a retractable overhead door. U.S. Pat. No. Des. 337,042 may be of interest for its disclosure of an angled bracket for overhead garage doors.

Thus, while the foregoing body of prior art indicates it to be well known to use overhead doors with headroom spaces whose vertical height is less than twelve inches, the prior art described above does not teach or suggest a roller bracket apparatus for an overhead door which has the following combination of desirable features: (1) does not use low headroom tracks; (2) does not employ known top brackets that are employed with overhead doors for which several inches have been cut from the bottoms of vertical portions of the roller tracks; (3) permits a vertical height for headroom space to be less than six inches; (4) permits the vertical height of headroom space to be no higher than the vertical distance required by the horizontal portions of roller tracks; (5) does not include door-pulling gear located above the horizontal portions of roller tracks; and (6) avoids the use of stationary, direction-changing corner wheels. The foregoing desired characteristics are provided by the unique roller bracket apparatus for an overhead door of the present invention as will be made apparent from the following description thereof. Other advantages of the present invention over the prior art also will be rendered evident.

SUMMARY OF THE INVENTION

To achieve the foregoing and other advantages, the present invention, briefly described, provides a roller bracket apparatus which includes a roller assembly which includes a carriage portion and a link portion projecting from the carriage portion. A push/pull assembly is provided, and a pivot assembly is connected between the link portion of the roller assembly and the push/pull assembly. The carriage portion includes a wheel-support portion and a plurality of axle/wheel assemblies supported by the wheel-support portion. Each of the axle/wheel assemblies includes an axle and a roller wheel connected to the axle.

The link portion extends from the carriage portion at an oblique extension angle. The push/pull assembly includes a first member connected to the pivot assembly, and a second member is connected to the first member. The push/pull assembly also includes a third member connected between the first member and the second member. The second member of the push/pull assembly is oriented with respect to the link portion of the roller assembly substantially in a straight line when the second member of the push/pull assembly is oriented with respect to the wheel-support portion of the roller assembly at a right angle.

On the other hand, the second member of the push/pull assembly is oriented with respect to the link portion of the roller assembly in an oblique link-to-second member orientation angle when the second member of the push/pull assembly is oriented with respect to the wheel-support portion of the roller assembly in a straight line. The link-to-second-member orientation angle is less than the extension angle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved roller bracket apparatus for an overhead door which has all of the advantages of the prior art and none of the disadvantages.

It is another object of the present invention to provide a new and improved roller bracket apparatus for an overhead door which may be easily and efficiently manufactured and marketed.

It is a further object of the present invention to provide a new and improved roller bracket apparatus for an overhead door which is of durable and reliable construction.

An even further object of the present invention is to provide a new and improved roller bracket apparatus for an overhead door which is susceptible of a low cost of manufacture with regard to both materials and labor, and which accordingly is then susceptible of low prices of sale to the consuming public, thereby making such roller bracket apparatus for an overhead door available to the buying public.

Still yet a further object of the present invention is to provide a new and improved roller bracket apparatus for an overhead door which does not use low headroom tracks.

Still another object of the present invention is to provide a new and improved roller bracket apparatus for an overhead door that does not employ known top brackets that are employed with overhead doors for which several inches have been cut from the bottoms of vertical portions of the roller tracks.

Yet another object of the present invention is to provide a new and improved roller bracket apparatus for an overhead door which permits a vertical height for headroom space to be less than six inches.

Even another object of the present invention is to provide a new and improved roller bracket apparatus for an overhead door that permits the vertical height of headroom space to be no higher than the vertical distance required by the horizontal portions of roller tracks.

Still a further object of the present invention is to provide a new and improved roller bracket apparatus for an overhead door which does not include door-pulling gear located above the horizontal portions of roller tracks.

Yet another object of the present invention is to provide a new and improved roller bracket apparatus for an overhead door that avoids the use of stationary, direction-changing corner wheels.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is a side view showing the embodiment of the invention of FIG. 1, showing more of the horizontal portion of the roller track, in a position wherein the overhead door is in either a partially or fully open position.

FIG. 3 is a top view of the embodiment of the invention shown in FIG. 1 taken along line 3—3 thereof.

FIG. 4 is a cross-sectional view of the embodiment of the invention shown in FIG. 1 taken along line 4—4 thereof.

DESCRIPTION OF THE PREFERRED EMBODIMENT

Figure 1:
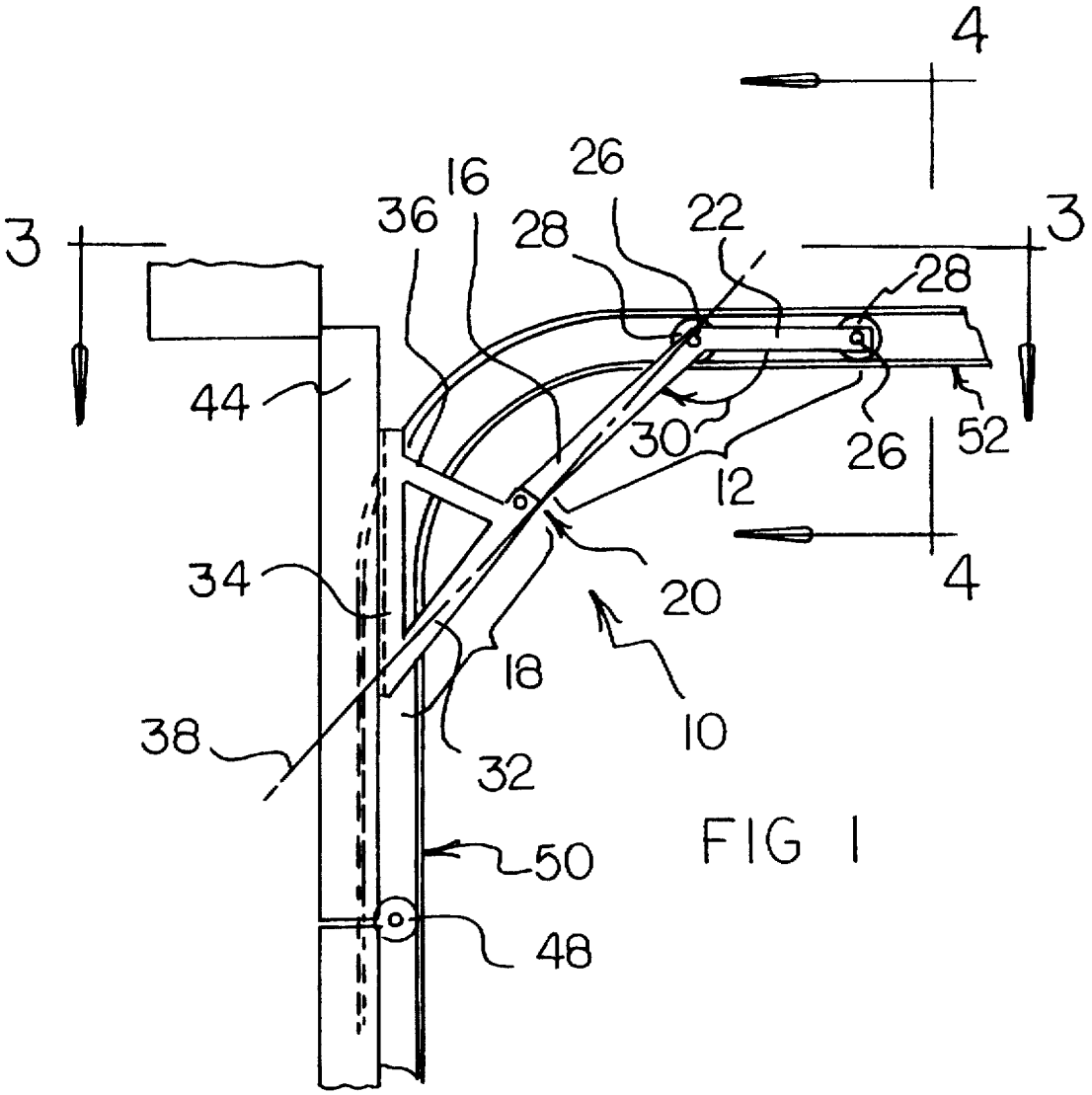
FIG. 1 is a side view showing a preferred embodiment of the roller bracket apparatus for an overhead door of the invention in a position wherein the overhead door is in a fully closed position.

With reference to the drawings, a new and improved roller bracket apparatus for an overhead door embodying the principles and concepts of the present invention will be described.

Turning to FIGS. 1–4, there is shown an exemplary embodiment of the roller bracket apparatus for an overhead door of the invention generally designated by reference numeral 10. In its preferred form, roller bracket apparatus 10 includes a roller assembly 12 which includes a carriage portion 14 and a link portion 16 projecting from the carriage portion 14. A push/pull assembly 18 is provided, and a pivot assembly 20 is connected between the link portion 16 of the roller assembly 12 and the push/pull assembly 18. The carriage portion 14 includes a wheel-support portion 22 and a plurality of axle/wheel assemblies supported by the wheel-support portion 22. Each of the axle/wheel assemblies includes an axle 26 and a roller wheel 28 connected to the axle 26.

The link portion 16 extends from the carriage portion 14 at an oblique extension angle 30. The push/pull assembly 18 includes a first member 32 connected to the pivot assembly 20, and a second member 34 is connected to the first member 32. The push/pull assembly 18 also includes a third member 36 connected between the first member 32 and the second member 34. The second member 34 of the push/pull assembly 18 is oriented with respect to the link portion 16 of the roller assembly 12 substantially in a straight line 38 when the second member 34 of the push/pull assembly 18 is oriented with respect to the wheel-support portion 22 of the roller assembly 12 at a right angle. Preferably, the link portion 16 and the first member 32 are equal in length.

On the other hand, the second member 34 of the push/pull assembly 18 is oriented with respect to the link portion 16 of the roller assembly 12 in an oblique link-to-second-member orientation angle 40 when the second member 34 of the push/pull assembly 18 is oriented with respect to the wheel-support portion 22 of the roller assembly 12 in a straight line 42. The link-to-second-side member orientation angle 40 is less than the extension angle 30.

In using the roller bracket apparatus 10 of the invention, the second member 34 of the push/pull assembly 18 is in the form of a flat plate which is connected to a top panel 44 of an overhead door using fasteners such as screws 46. Rollers 48 are provided between adjacent panels in the overhead door. The rollers 48 are connected to the panels and the roller wheels 28 of the roller assembly 12 of the invention ride in a track which includes a vertical track portion 50 and a horizontal track portion 52.

As shown in FIG. 1, the overhead door is closed and the top panel 44 is in a vertical orientation. When the overhead door is closed, the wheel-support portion 22 of the roller assembly 12 is in the horizontal track portion 52, the second member 34 of the push/pull assembly 18 and the wheel-support portion 22 of the roller assembly 12 are oriented with respect to each other at a right angle, and the first member 32 of the push/pull assembly 18 and the link portion 16 of the roller assembly 12 are oriented with respect to each other substantially in a straight line 38.

As shown in FIG. 2, when the overhead door is opened, the wheel-support portion 22 of the roller assembly 12 moves further into the horizontal track portion 52, and the link portion 16 pulls on the pivot assembly 20 which pulls the push/pull assembly 18 towards the horizontal track portion 52. As the overhead door is pulled into an open position, the top panel 44 is pulled into the horizontal orientation. As the overhead door is opened more fully, additional panels are oriented horizontally as shown in FIG. 2. As the link portion 16 of the roller assembly 12 pulls the top panel 44 to a horizontal orientation, the angle between the first member 32 of the push/pull assembly 18 and the link portion 16 changes. When the top panel 44 is oriented horizontally, the link-to-second-member orientation angle 40 is an oblique angle which is a smaller angle than the oblique extension angle 30.

The components of the roller bracket apparatus for an overhead door of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved roller bracket apparatus for an overhead door that is low in cost, relatively simple in design and operation, and which may advantageously be used without using low headroom tracks. With the invention, a roller bracket apparatus for an overhead door is provided which does not employ known top brackets that are employed with overhead doors for which several inches have been cut from the bottoms of vertical portions of the roller tracks. With the invention, a roller bracket apparatus for an overhead door is provided which permits a vertical height for headroom space to be less than six inches. With the invention, a roller bracket apparatus for an overhead door is provided which permits the vertical height of headroom space to be no higher than the vertical distance required by the horizontal portions of roller tracks. With the invention, a roller bracket apparatus for an overhead door is provided which does not include door-pulling gear located above the horizontal portions of roller tracks. With the invention, a roller bracket apparatus for an overhead door is provided which avoids the use of stationary, direction-changing corner wheels.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U. S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A roller bracket apparatus comprising:

an overhead door including adjacent panels and panel rollers mounted between the adjacent panels, the adjacent panels including a top panel;

a track including a vertical track portion and a horizontal track portion, the panel rollers of the overhead door being positioned in the vertical track portion of the track;

a roller assembly including a rigid wheel-support portion having a first end and a second end, a first axle/wheel assembly rotatably mounted to the first end of the wheel-support portion, a second axle/wheel assembly rotatably mounted to the second end of the wheel-support portion, and a link portion fixedly secured to the first end of the wheel-support portion and projecting at a first oblique angle therefrom, the axle/wheel assemblies of the roller assembly being positioned within only the horizontal track portion of the track such that the roller assembly moves in a horizontal direction only and such that the link portion is at all times movably supported at the first oblique angle relative to the horizontal track portion of the track;

a push/pull assembly including a second member fixedly secured to the top panel of the overhead door, a first member fixedly secured to the second member and projecting at a second oblique angle therefrom, the second member supporting the first member at the second oblique angle relative to an interior surface of the top panel, a distal end of the link portion being pivotally mounted to a distal end of the first member;

whereby a horizontal movement of the roller assembly, per se, within the horizontal track portion of the track causes only pivoting of the top panel about one of the panel rollers mounted between the adjacent panels without causing any correspondingly upward movement of the top panel.

2. The apparatus of claim 1, wherein the link portion and the first member are equal in length.

3. The apparatus of claim 1, wherein the first member of the push/pull assembly is oriented with respect to the link portion of said roller assembly in a substantially straight line when the second member of the push/pull assembly is oriented at a right angle with respect to the wheel-support portion of the roller assembly.

* * * * *